US009842542B2

(12) United States Patent
Duan et al.

(10) Patent No.: US 9,842,542 B2
(45) Date of Patent: Dec. 12, 2017

(54) DISPLAY APPARATUS HAVING A PIXEL STRUCTURE FOR DRIVING A PLURALITY OF ORGANIC LIGHT-EMITTING DIODES

(71) Applicant: BOE TECHNOLOGY GROUP CO., LTD., Beijing (CN)

(72) Inventors: Liye Duan, Beijing (CN); Lirong Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 14/894,707

(22) PCT Filed: Apr. 17, 2015

(86) PCT No.: PCT/CN2015/076847
§ 371 (c)(1),
(2) Date: Nov. 30, 2015

(87) PCT Pub. No.: WO2016/110021
PCT Pub. Date: Jul. 14, 2016

(65) Prior Publication Data

US 2016/0307510 A1 Oct. 20, 2016

(30) Foreign Application Priority Data

Jan. 5, 2015 (CN) ..... 2015 1 0002771

(51) Int. Cl.
*G09G 3/32* (2016.01)
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0426* (2013.01);
(Continued)

(58) Field of Classification Search
CPC ..... G09G 3/3258; G09G 3/3233
(Continued)

(56) References Cited

U.S. PATENT DOCUMENTS 6,618,031 B1 9/2003 Bohn, Jr. et al.
7,256,758 B2 8/2007 Hu et al.
(Continued)

FOREIGN PATENT DOCUMENTS

CN 1790468 A 6/2006
CN 1801298 A 7/2006
(Continued)

OTHER PUBLICATIONS

Second Chinese Office Action dated Sep. 7, 2016.
(Continued)

*Primary Examiner* — Long D Pham
(74) *Attorney, Agent, or Firm* — Dilworth & Barrese, LLP.; Michael J. Musella, Esq.

(57) ABSTRACT

There are provided a pixel structure, a display panel and a display apparatus. The pixel structure comprises a pixel circuit (11), a switch circuit (12) and n organic light-emitting diodes (13) sharing the pixel circuit (11), where n is greater than or equal to 2. Respective organic light-emitting diodes (13) sharing the pixel circuit (11) are located in a same column of the display panel, and emit lights of a same color when emitting light. The switch circuit (12) is configured to control any two organic light-emitting diodes (13) sharing the pixel circuit (11) to emit light at different periods of time. The pixel circuit (11) is configured to drive of the respective organic light-emitting diodes sharing the pixel circuit (11) to emit light according to a received data signal. The pixel structure is used to solve the problem of the complexity of the back board.

17 Claims, 4 Drawing Sheets

(52) U.S. Cl.
CPC ..... *G09G 2300/0465* (2013.01); *G09G 2300/0804* (2013.01); *G09G 2300/0809* (2013.01); *G09G 2300/0814* (2013.01); *G09G 2300/0842* (2013.01); *G09G 2300/0861* (2013.01)

(58) Field of Classification Search
USPC ..... 345/82
See application file for complete search history.

(56) References Cited

U.S. PATENT DOCUMENTS

2005/0264497 A1* 12/2005 Shin ..... G09G 3/3233 345/76
2005/0285827 A1 12/2005 Eom
2006/0103611 A1* 5/2006 Choi ..... G09G 3/3233 345/82
2006/0114193 A1 6/2006 Kwak et al.
2006/0139257 A1* 6/2006 Kwak ..... G09G 3/3233 345/76
2014/0167011 A1* 6/2014 Huangfu ..... G09G 3/3225 257/40

FOREIGN PATENT DOCUMENTS

CN 203444736 U 2/2014
CN 103872091 A 6/2014
CN 104134426 A 11/2014
CN 104464644 A 3/2015

OTHER PUBLICATIONS

Chinese Office Action dated Sep. 7, 2016.
Chinese Office Action dated Apr. 26, 2016.
Search Report and Written Opinion dated Sep. 23, 2015 from State Intellectual Property Office of the P.R. China.

* cited by examiner

DISPLAY APPARATUS HAVING A PIXEL STRUCTURE FOR DRIVING A PLURALITY OF ORGANIC LIGHT-EMITTING DIODES

TECHNICAL FIELD

The present disclosure relates to a pixel structure, a display panel and a display apparatus.

BACKGROUND

An organic light-emitting diode (OLED) influences electronic consumption market with its characteristics of energy efficiency, good display effect and so on. Now, OLED display screen has already been applied to a variety of consumer electronics widely.

In the active matrix organic light emitting diode (AMOLED) panel design, a problem to be solved is luminance non-uniformity among pixels. There are many kinds of pixel circuits having the functions of compensating for non-uniformity and drift of the threshold voltage and non-uniformity of OLED, but a configuration of the pixel circuit having the compensation function is relatively complicated, which would increase its occupation area on a back board, so that the increase of pixel density under certain process capability becomes a bottleneck.

At present, the configuration of the pixel circuit having the compensation function is relatively complicated, which results in that the area occupied by the pixel circuit on the back board increases. However, each sub-pixel on the AMOLED panel needs to use different circuits. Therefore, for a display panel having the same size, when the same back board process is adopted, the more complicated the configuration of the pixel circuit is, the lower the pixel density on the display panel is. That is, since the configuration of the pixel circuit having the compensation function is completed, and each sub-pixel on the AMOLED panel needs to use different pixel circuits, in order to raise the pixel density on the display panel, the back board process capability needs to be improved, so that more pixel circuits having the compensation function can be manufactured on the back board with the same area.

To sum up, since the configuration of the pixel circuit having the compensation function is relatively complicated, and each sub-pixel on the AMOLED panel needs to use different pixel circuits, in order to raise the pixel density on the display panel, complexity of the back board process would increase.

SUMMARY

There are provided in some embodiments of the present disclosure a pixel structure, a display panel and a display apparatus, which are used to solve the problem that when a configuration of a pixel circuit is relatively complicated, since each sub-pixel on the AMOLED panel needs to use different pixel circuits, complexity of the back board process would increase if pixel density of the display panel needs to be increased.

There is provided in an embodiment of the present disclosure a pixel structure, comprising a pixel circuit, a switch circuit and n organic light-emitting diodes sharing the pixel circuit, where n is greater than or equal to 2.

Respective organic light-emitting diodes sharing the pixel circuit are located in a same column of the display panel, and emit lights of a same color when emitting light.

The switch circuit is configured to control any two organic light-emitting diodes sharing the pixel circuit to emit light in different periods of time.

The pixel circuit is configured to drive of the respective organic light-emitting diodes sharing the pixel circuit to emit light according to a received data signal.

There is provided in an embodiment of the present disclosure a display panel, comprising at least one pixel structure provided in the embodiment of the present disclosure.

There is provided in an embodiment of the present disclosure a display apparatus, comprising a display panel provided in the embodiment of the present disclosure.

In the pixel structure, the display panel and the display apparatus provided in the embodiments of the present disclosure, since a plurality of organic light-emitting diodes of the same color located in the same column of the display panel share one pixel circuit through the switch circuit, the switch circuit can control any two organic light-emitting diodes sharing one pixel circuit to emit light in different periods of time. Therefore, when the pixel density on the display panel raises, since a plurality of OLEDs can share one pixel circuit, the number of the pixel circuits in the display panel would not increase a lot or even would not increase, so that complexity of the back board process can be reduced.

DETAILED DESCRIPTION

In a pixel structure, a display panel and a display apparatus provided in the embodiments of the present disclosure, since a plurality of OLEDs can share one pixel circuit, when pixel density on the display panel raises, the number of pixel circuits in the display panel would not increase a lot or even would not increase, so that complexity of the back board process can be reduced.

Specific implementations of the pixel structure, the display panel and the display apparatus provided in embodiments of the present disclosure will be described below in detail by combining with figures of the specification.

Figure 1A:
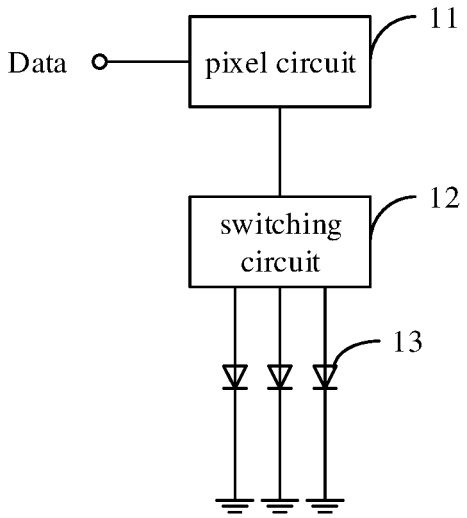
FIG. 1*a* is a schematic diagram of a pixel structure provided in an embodiment of the present disclosure.
Figure 1B:
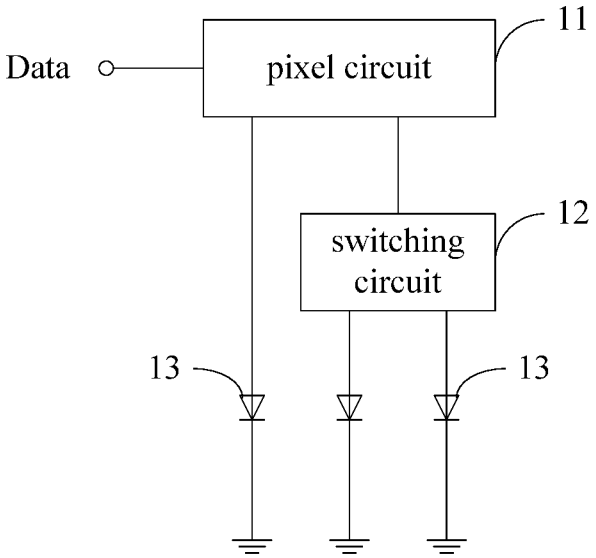
FIG. 1*b* is a schematic diagram of another pixel structure provided in an embodiment of the present disclosure.

FIGS. 1*a* and 1*b* show a schematic diagram of an exemplary pixel structure provided in an embodiment of the present disclosure respectively.

As shown in FIG. 1*a* or 1*b*, a pixel structure provided in the embodiment of the present disclosure can comprise: a pixel circuit 11, a switch circuit 12 and n organic light-emitting diodes 13 sharing the pixel circuit, where n is greater than or equal to 2.

Respective organic light-emitting diodes 13 sharing the pixel circuit 11 are located in a same column of the display panel, and emit lights of a same color when emitting light.

The switch circuit 12 is configured to control any two organic light-emitting diodes 13 sharing the pixel circuit 11 to emit light in different periods of time.

The pixel circuit 11 is configured to drive the respective organic light-emitting diodes 13 sharing the pixel circuit to emit light according to a received data signal Data.

FIGS. 1*a* and 1*b* are described by taking three organic light-emitting diodes sharing one pixel circuit as an example. The pixel circuit in FIG. 1*a* or 1*b* can be a pixel circuit having any configuration. Herein, the pixel circuit in FIG. 1*a* may comprise a transistor for controlling light emitting, or may not comprise a transistor for controlling light emitting. The pixel circuit in FIG. 1*b* comprises a transistor for controlling light emitting, and the transistor for controlling light emitting is not shown in FIG. 1*b*.

Further, the switch circuit can comprise n transistors.

Figure 2A:
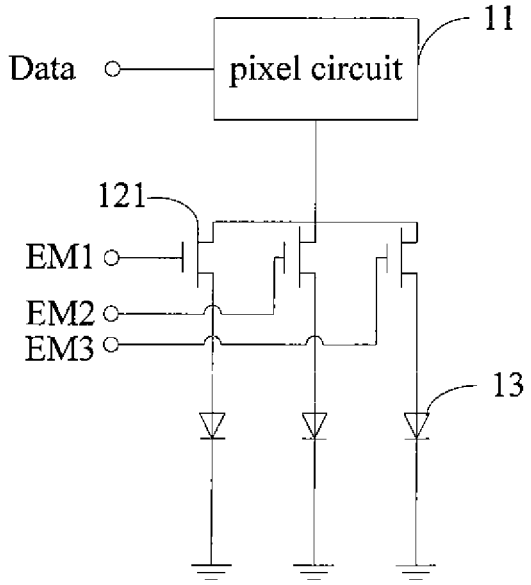
FIG. 2*a* is a schematic diagram of yet another pixel structure provided in an embodiment of the present disclosure.

FIG. 2*a* shows a schematic diagram of another exemplary pixel structure provided in an embodiment of the present disclosure.

As shown in FIG. 2*a*, the respective organic light-emitting diodes 13 sharing the pixel circuit 11 are connected to the pixel circuit 11 through one different transistor 121 in the switch circuit 12 respectively. That is, the respective organic light-emitting diodes 13 sharing the pixel circuit 11 are connected to the pixel circuit 11 through one transistor 121 in the switch circuit 12 respectively, and different organic light-emitting diodes 13 are connected to the pixel circuit 11 through different transistors 121. Gates of three transistors 121 in FIG. 2*a* receive different light-emitting signals EM1, EM2 and EM3 respectively.

Further, the pixel circuit 11 can comprise a transistor 111 used to control light emitting, and the switch circuit 12 comprises (n−1) transistors.

Figure 2B:
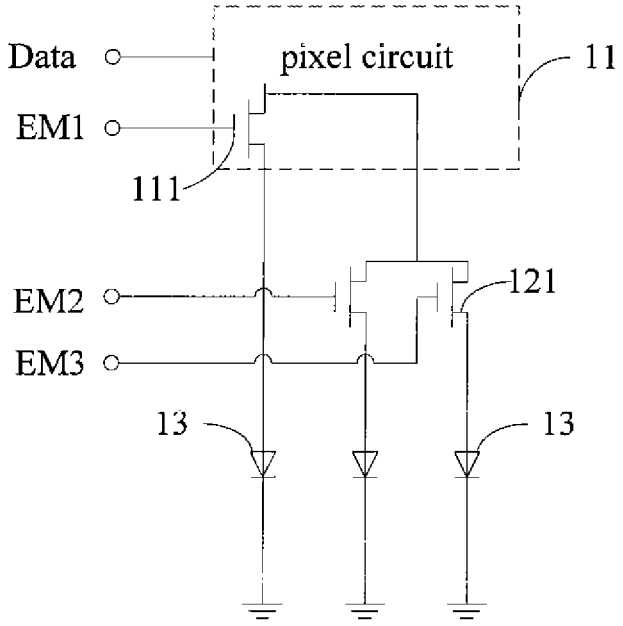
FIG. 2*b* is a schematic diagram of yet another pixel structure provided in an embodiment of the present disclosure.

FIG. 2*b* shows a schematic diagram of yet another exemplary pixel structure provided in an embodiment of the present disclosure.

As shown in FIG. 2*b*, one of n organic light-emitting diode 13 sharing the pixel circuit 11 is connected to one electrode (when this electrode is a source, the other electrode is a drain; when this electrode is a drain, the other electrode is a source) except for the gate of the transistor 111 used to control light emitting in the pixel circuit 11, and the transistor 111 used to control light emitting controls the organic light-emitting diode 13 connected to the transistor 111 to emit light. The respective organic light-emitting diode 13, except for those directly connected to the pixel circuit 11, of the n organic light-emitting diode 13 sharing the pixel circuit 11, are connected to the other electrode except for the gate of the transistor for controlling light emitting in the pixel circuit 11 through one different transistor 121 in the switch circuit 12 respectively. That is, the respective organic light-emitting diodes 13, except for those directly connected to the pixel circuit 11, of the n organic light-emitting diodes 13 sharing the pixel circuit 11 are connected to the other electrode except for the gate of the transistor for controlling light emitting in the pixel circuit 11 through one transistor 121 in the switch circuit 12 respectively. Different organic light-emitting diodes 13 are connected to the pixel circuit 11 through different transistors 121. The gate of the transistor for controlling light emitting in the pixel circuit 11 in FIG. 2*b* receives the light-emitting signal EM1, and gates of the two transistors 121 receive different light-emitting signals EM2 and EM3 respectively.

Optionally, the pixel circuit in the pixel structure provided in the embodiment of the present disclosure is a pixel circuit having the function of compensating for the threshold voltage.

Exemplarily, in the pixel structure provided in the embodiment of the present disclosure, two organic light-emitting diodes share the pixel circuit in the pixel structure.

Exemplarily, the two light-emitting diodes sharing the pixel circuit in the pixel structure provided in the embodiment of the present disclosure are adjacent.

Figure 3:
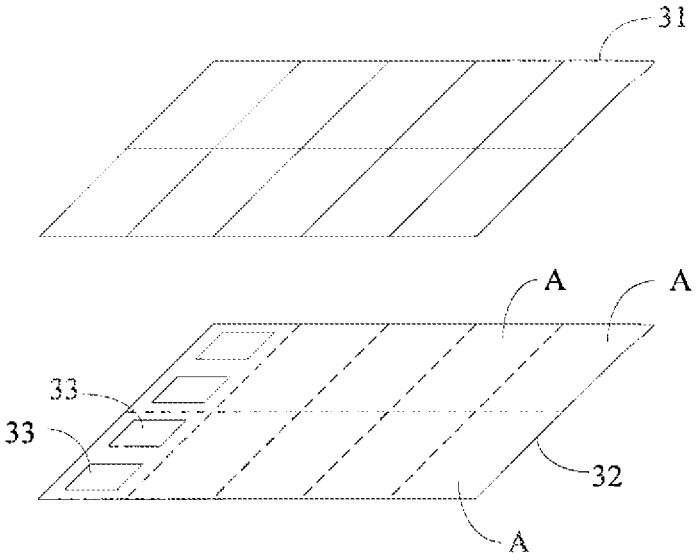
FIG. 3 is a schematic diagram of a position relationship, in a display panel, of two OLEDs sharing one pixel circuit in a pixel structure provided in an embodiment of the present disclosure.

FIG. 3 is a schematic diagram of a position relationship, in a display panel, of two OLEDs sharing one pixel circuit in a pixel structure provided in an embodiment of the present disclosure.

Exemplarily, as shown in FIG. 3, the two light-emitting diodes sharing a pixel circuit in the pixel structure provided in the embodiment of the present disclosure are located in a same evaporation region A.

Herein, one evaporation region A is a region on a substrate 32 covered by a hole H on a mask plate 31 when a light-emitting layer 33 in the organic light-emitting diode is evaporated.

Anodes of two organic light-emitting diodes in the same evaporation region A are connected to the same pixel circuit through the switch circuit respectively. Or, an anode of one organic light-emitting diode in the same evaporation region A is connected to one pixel circuit, and an anode of the other organic light-emitting diode in the evaporation region A is connected to the pixel circuit through the switch circuit. At this time, the pixel circuit comprises the transistor for controlling light emitting.

Two OLEDs are manufactured in the same evaporation region. In the case that the pixel density on the display panel is unchanged, the complexity in the design of the mask plate can be reduced.

A display panel provided in the embodiment of the present disclosure comprises at least one pixel structure provided in the embodiment of the present disclosure.

Figure 4:
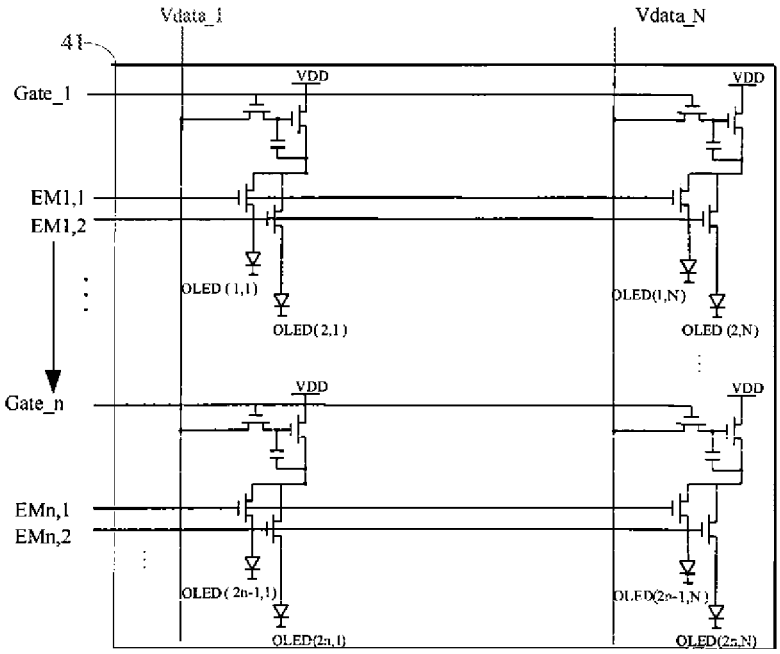
FIG. 4 is a schematic diagram of a configuration of a display panel provided in an embodiment of the present disclosure.

FIG. 4 shows a schematic diagram of a configuration of the display panel provided in an embodiment of the present disclosure.

Exemplarily, as shown in FIG. 4, the display panel 41 provided in the embodiment of the present disclosure comprises a plurality of pixel structures provided in the embodiment of the present disclosure. Each two organic light-emitting diodes in the display panel 41 share one pixel circuit.

For example, OLED (1, 1) and OLED (1, 2) share one pixel circuit, OLED (1, N) and OLED (2, N) share one pixel circuit, OLED (2*n*+1, 1) and OLED (2*n*, 1) share one pixel circuit, and OLED (2*n*+1, N) and OLED (2*n*, N) share one pixel circuit. Furthermore, in FIG. 4, gates of transistors in the switch circuit connected to the organic light-emitting diodes of the same row receive the same light-emitting signal. For example, both a gate of a transistor in the switch circuit connected to OLED (1, 1) and a gate of a transistor in the switch circuit connected to OLED (1, N) receive a light-emitting signal EM1, 1. Both a gate of a transistor in the switch circuit connected to OLED (2, 1) and a gate of a transistor in the switch circuit connected to OLED (2, N) receive a light-emitting signal EM1, 2. Both a gate of a transistor in the switch circuit connected to OLED (2*n*−1, 1) and a gate of a transistor in the switch circuit connected to OLED (2*n*−1, N) receive a light-emitting signal EMn, 1. A gate of a transistor in the switch circuit connected to OLED (2*n*, 1) and a gate of a transistor in the switch circuit connected to OLED (2*n*, N) receive a light-emitting signal EMn, 2. Respective pixel circuits in FIG. 4 further receive different data signals, respectively, such as Vdata_1, . . . Vdata_N. Respective pixel circuits in FIG. 4 further receive different scanning signals, such as $Gate_{13}$ 1, . . . Gate_n.

The pixel circuit in FIG. 4 is a structure of 2T1C. Of course, the pixel circuit can adopt other structures.

Figure 5:
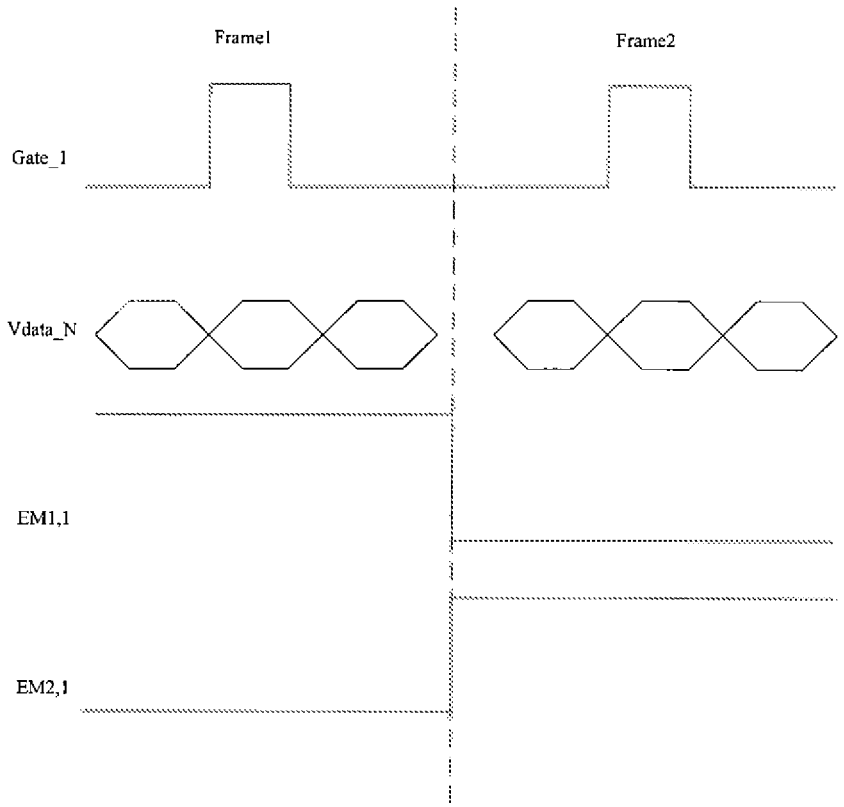
FIG. 5 is an operation timing diagram of two OLEDs sharing one pixel circuit in a display panel provided in an embodiment of the present disclosure.

FIG. 5 shows an operation timing diagram of two organic light-emitting diodes sharing one pixel circuit in the display panel 41 as shown in FIG. 4 when the two organic light-emitting diodes display adjacent two frame images.

As shown in FIG. 5, when a previous frame image Frame 1 of the adjacent two frame images is displayed, the switch circuit controls an organic light-emitting diode, located in a previous row, of the two organic light-emitting diodes sharing the pixel circuit connected thereto to emit light. That is, when the previous frame image Frame 1 of the adjacent two frame images is displayed, the transistor in the switch circuit connected to OLED (1,1) is turned on, the transistor in the switch circuit connected to OLED (1,N) is turned on, the transistor in the switch circuit connected to OLED (2*n*−1, 1) is turned on, and the transistor in the switch circuit connected to OLED (2*n*−1, N) is turned on. When the display panel displays a next frame image Frame 2 of the adjacent two frame images, the switch circuit controls an organic light-emitting diode, located in a next row, of two organic light-emitting diodes sharing the pixel circuit connected thereto to emit light. That is, when the next frame image Frame 2 of the adjacent two frame images is displayed, the transistor in the switch circuit connected to OLED (2,1) is turned on, the transistor in the switch circuit connected to OLED (2,N) is turned on, the transistor in the switch circuit connected to OLED (2*n*, 1) is turned on, and the transistor in the switch circuit connected to OLED (2*n*, N) is turned on.

The timing diagram as shown in FIG. 5 is the operation timing diagram when OLED (1, N) and OLED (2, N) in the display panel display the adjacent two frame images.

Because every two adjacent OLEDs of the same color (that is, the OLED emits light of the same color when emitting light) in the same column of the display panel share one pixel circuit, in the case that the pixel density on the display panel is unchanged, the number of the pixel circuits would be reduced greatly. And with the decreasing of the number of the pixel circuit, the number of GOA units would also be reduced, which is advantageous for manufacturing a display apparatus with a narrower frame.

A display apparatus provided in an embodiment of the present disclosure comprises a display panel provided in the embodiments of the present disclosure.

Those skilled in the art can understand that the modules in the apparatus in the above embodiments can be distributed in the apparatus of the embodiment according to the description of the present embodiment, or can be changed correspondingly to be disposed in one or more apparatuses being different from the apparatus in the present embodiment. According to the requirement in the implementation process, the modules in the above embodiment can be combined into one module, or can be further divided into a plurality of sub-modules.

The above descriptions are just exemplary embodiments of the present disclosure, but are not used to define the protection scope of the present disclosure. Those skilled in the art can make various alternations and modifications to the embodiments of the present disclosure without departing from the spirit and scope of the present disclosure. The protection scope of the present disclosure shall be subjected to the protection scope of the claims.

The present application claims the priority of a Chinese patent application No. 201510002771.9 filed on Jan. 5, 2015. Herein, the content disclosed by the Chinese patent application is incorporated in full by reference as a part of the present disclosure.

What is claimed is:

1. A pixel structure, comprising: a pixel circuit, a switch circuit and n organic light-emitting diodes sharing the pixel circuit, where n is greater than or equal to 2, wherein respective organic light-emitting diodes sharing the pixel circuit are located in a same column of the display panel, and emit lights of a same color when emitting light;

the switch circuit is configured to control any two organic light-emitting diodes sharing the pixel circuit to emit light in different periods of time; and the pixel circuit is configured to drive the respective organic light-emitting diodes sharing the pixel circuit to emit light according to a received data signal, wherein the pixel circuit comprises a transistor for controlling light emitting, and the switch circuit comprises (n−1) transistors;

one organic light-emitting diode of the n organic light-emitting diodes sharing the pixel circuit is connected to one electrode except for a gate of the transistor for controlling light emitting in the pixel circuit, and the transistor for controlling light emitting controls an organic light-emitting diode connected thereto to emit light; and respective organic light-emitting diodes, except for those directly connected to the pixel circuit, of the n organic light-emitting diodes sharing the pixel circuit, are connected to the other electrode except for the gate of the transistor for controlling light emitting in the pixel circuit through one different transistor in the switch circuit respectively.

2. The pixel structure according to claim 1, wherein the switch circuit comprises n transistors; and the respective organic light-emitting diodes sharing the pixel circuit are connected to the pixel circuit through one different transistor in the switch circuit respectively.

3. The pixel structure according to claim 1, wherein the pixel circuit is a pixel circuit having a function of compensating for a threshold.

4. The pixel structure according to claim 1, wherein two organic light-emitting diodes share the pixel circuit.

5. The pixel structure according to claim 4, wherein the two light-emitting diodes sharing the pixel circuit are adjacent.

6. The pixel structure according to claim 5, wherein the two light-emitting diodes sharing the pixel circuit are located in a same evaporation region;

wherein one evaporation region is a region on a substrate covered by a hole on a mask plate when a light-emitting layer in the organic light-emitting diode is evaporated.

7. The pixel structure according to claim 4, wherein the switch circuit comprises n transistors; and the respective organic light-emitting diodes sharing the pixel circuit are connected to the pixel circuit through one different transistor in the switch circuit respectively.

8. The pixel structure according to claim 4, wherein the pixel circuit is a pixel circuit having a function of compensating for a threshold.

9. A display panel, comprising at least one pixel structure according to claim 1.

10. The display panel according to claim 9, wherein the display panel comprises a plurality of pixel structures, and every two organic light-emitting diodes in the display panel share one pixel circuit;

when the display panel displays a previous frame image of adjacent two frame images, a switch circuit controls an organic light-emitting diode, located in a previous row, of two organic light-emitting diodes sharing a pixel circuit connected thereto to emit light;

when the display panel displays a next frame image of the adjacent two frame images, the switch circuit controls an organic light-emitting diode, located in a next row, of two organic light-emitting diodes sharing the pixel circuit connected thereto to emit light.

11. A display apparatus, comprising the display panel according to claim 10.

12. A display apparatus, comprising the display panel according to claim 9.

13. The display panel according to claim 9, wherein the switch circuit comprises n transistors; and the respective organic light-emitting diodes sharing the pixel circuit are connected to the pixel circuit through one different transistor in the switch circuit respectively.

14. The display panel according to claim 9, wherein the pixel circuit is a pixel circuit having a function of compensating for a threshold.

15. The display panel according to claim 9, wherein two organic light-emitting diodes share the pixel circuit.

16. The display panel according to claim 15, wherein the two light-emitting diodes sharing the pixel circuit are adjacent.

17. The display panel according to claim 16, wherein the two light-emitting diodes sharing the pixel circuit are located in a same evaporation region;

wherein one evaporation region is a region on a substrate covered by a hole on a mask plate when a light-emitting layer in the organic light-emitting diode is evaporated.

* * * * *